US005448677A

United States Patent [19]

Fell et al.

[11] Patent Number: 5,448,677

[45] Date of Patent: Sep. 5, 1995

[54] ELECTRIC HAIR DRYER WITH CLOGGED FILTER INDICATOR

[75] Inventors: Rüdiger Fell, Königstein; Wilfried Rolf, Runkel-Eschenau; Boris Wonka, Neu-Isenburg, all of Germany

[73] Assignee: Braun Aktiengesellschaft, Frankfurt, Germany

[21] Appl. No.: 231,994

[22] Filed: Apr. 21, 1994

Related U.S. Application Data

[63] Continuation of Ser. No. 881,854, May 12, 1992, abandoned.

[30] Foreign Application Priority Data

Jun. 9, 1991 [DE] Germany ..... 41 19 020.3

[51] Int. Cl.[6] ..... A45D 20/30; H05B 1/02

[52] U.S. Cl. ..... 392/383; 34/85; 34/97; 73/204.25; 55/274; 340/607

[58] Field of Search ..... 392/379–385, 392/360, 365; 34/82, 85, 96–101; 73/204.17, 204.25; 55/274; 340/407, 607

[56] References Cited

U.S. PATENT DOCUMENTS

| | | | |
|---|---|---|---|
| 2,514,528 | 7/1950 | Wahl | 392/385 X |
| 2,625,239 | 1/1953 | Senne | 55/274 X |
| 3,611,337 | 10/1971 | Balzer et al. | 55/274 X |
| 3,812,370 | 5/1974 | La Violette | 55/274 X |
| 3,955,065 | 5/1976 | Chambon | 392/384 |
| 4,311,995 | 1/1982 | Kinzie | 340/607 |
| 4,634,839 | 1/1987 | Gilbertson | 392/385 X |
| 4,642,128 | 2/1987 | Solozano | 55/274 X |
| 5,111,692 | 5/1992 | McQueen et al. | 73/204.17 |

FOREIGN PATENT DOCUMENTS

| | | | |
|---|---|---|---|
| 3724343 | 2/1989 | Germany . | |
| 59-71785 | 4/1984 | Japan | 34/85 |
| 1-317518 | 12/1989 | Japan | 55/274 |
| 2-305599 | 12/1990 | Japan | 34/82 |
| 2176292 | 12/1986 | United Kingdom | 73/204.25 |

OTHER PUBLICATIONS

Braun PF1600 hair dryer product literature, 1990.

*Primary Examiner*—John A. Jeffery
*Attorney, Agent, or Firm*—Fish & Richardson

[57] ABSTRACT

A hair dryer has a housing including an air inlet opening and an air exit opening for passage of an air stream. The housing accommodates a blower structure and a heater, and the air inlet opening has associated to it a filter element. Provided in the housing are a detector producing an output signal in dependence upon at least one temperature prevailing in the housing and having associated thereto a signaling device which is actuatable on attainment of a predeterminable threshold value of the output signal. The signaling device indicates to the user of the hair dryer that the filter element requires cleaning or replacement.

12 Claims, 2 Drawing Sheets

ELECTRIC HAIR DRYER WITH CLOGGED FILTER INDICATOR

Figure 1:
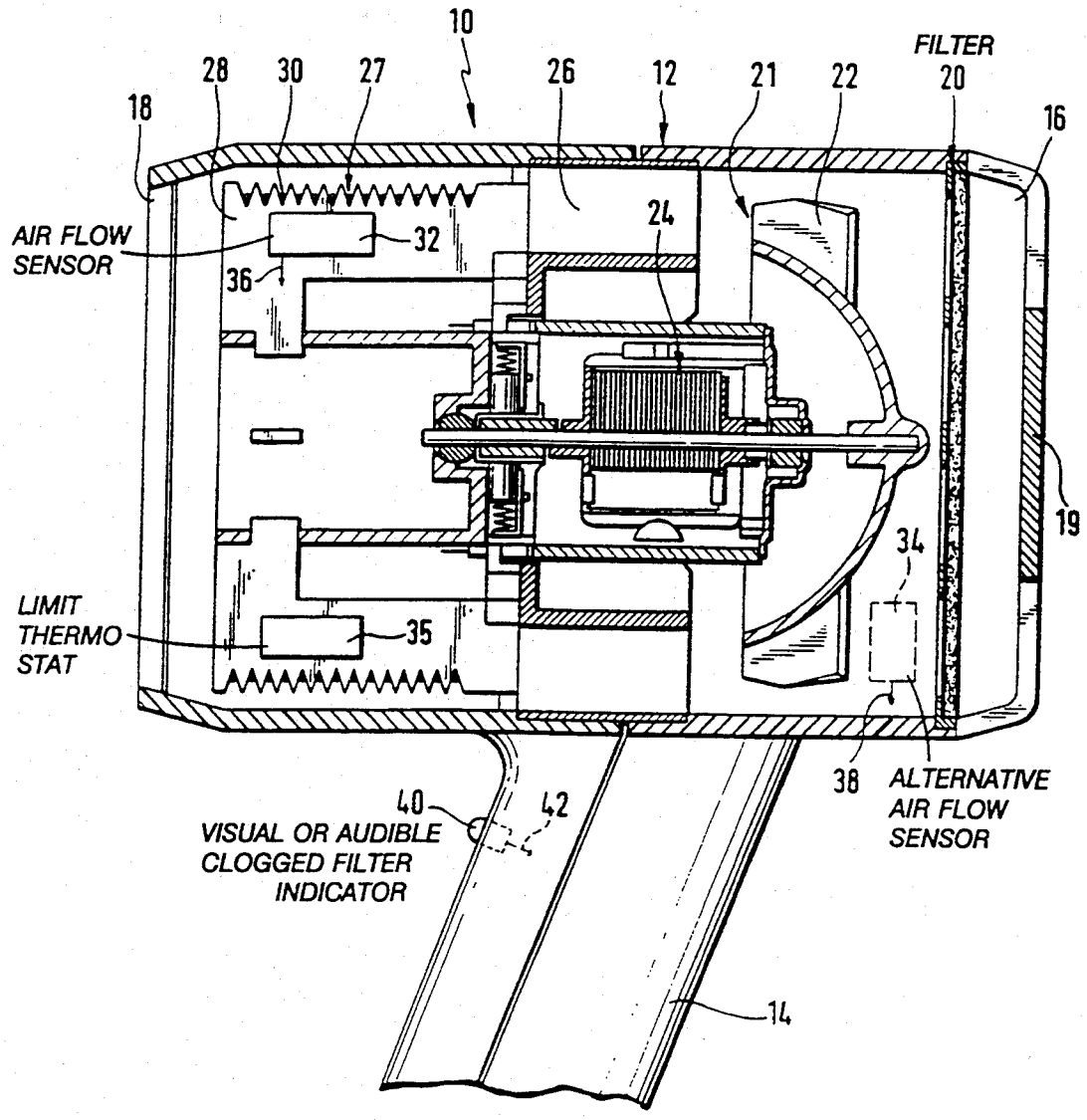
Figure 2A:
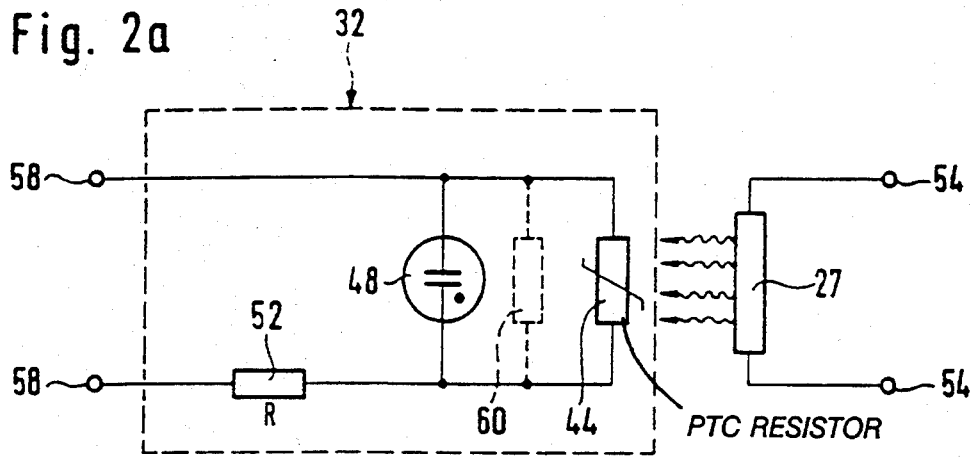
Figure 2B:
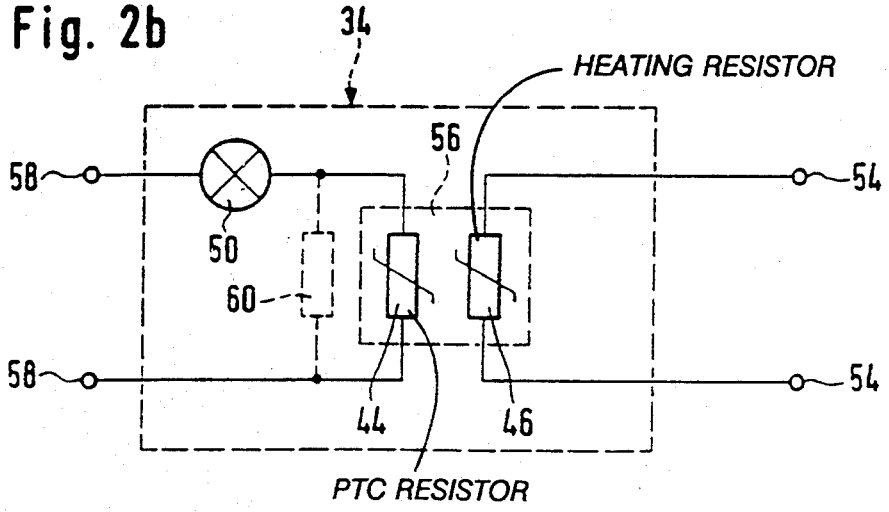

This is a continuation of application Ser. No. 07/881,854, filed May 12, 1992, now abandoned.

This invention relates to a hair dryer having a housing including an air inlet opening and an air exit opening for passage of an air stream, wherein a blower and a heating means are arranged in the housing and the air inlet opening has associated to it a filter element.

A hair dryer of the applicant has been commercially available for a prolonged time under the model name PFV 1600. These appliances are well proven in practice, which is attributable, last but not least, to the filter element arranged in the air inlet opening and retaining foreign particles, such as hair from the air drawn in. A demountable air inlet grille allows ready replacement or cleaning of the filter element.

However, experience has also shown that some users of such hair dryers, because of ignorance or carelessness, have a tendency not to exchange or clean the filter element from time to time. As a result, with the filter element becoming progressively contaminated, the rate of air flow required for sufficient cooling of the heating means of the hair dryer is gradually reduced to an inadmissibly high extent. In the extreme case, this may render the hair dryer inoperable or damage it.

It is therefore an object of the present invention to improve upon a hair dryer of the known type such that an inadmissibly high contamination or clogging of the filter element is avoided.

By providing in the housing detecting means producing an output signal in dependence upon at least one temperature prevailing in the housing and having associated thereto a signaling device actuatable on attainment of a predeterminable threshold value of the output signal, a signaling device is advantageously activated on detection of an abnormally high temperature in the hair dryer housing or a clogged condition of the filter element. Because the detecting means are responsive to the actual inside temperature of the housing, the output signal is independent of the air flow or heat setting selected for the individual application, so that also line voltage fluctuations are compensated for. When the hair dryer is operated at low air flow or heat settings or the line voltage drops below the rated voltage, the inside temperatures are lower and thus no longer critical at the same degree of contamination of the filter element. In this event, the signaling device is not activated. Only when the contamination reaches a degree causing inadmissibly high temperatures will the signaling device be activated. The converse effect occurs when the supply voltage becomes too high. In this event, a degree of contamination lower than under rated voltage conditions will suffice to produce inadmissibly high temperatures inside the housing, so that the signaling device will be activated in a correspondingly earlier stage.

In a particularly advantageous embodiment, the detecting means include a temperature sensor, in particular a PTC element. The resistance of this temperature sensor or PTC element is dependent on the ambient temperature. The variation of the resistance of the PTC element or temperature sensor or of the voltage drop occurring across this element may be readily used as an output signal and referred to for activation of the signaling device when a value exceeds or falls below a specific predeterminable threshold. Preferably, visual signal elements as, for example, light-emitting diodes or glow lamps, or audible signal elements will find application as signaling devices.

In a particular embodiment of the present invention, the detecting means are associated with the heating means of the hair dryer, being in particular mounted on a heater supporting structure.

In a further embodiment of the present invention, the detecting means are configured as a series circuitry comprising a series resistor and a PTC element having a visual signal element, particularly a glow lamp, in parallel arrangement. The threshold value at which the signal element indicates to the user that the temperatures are inadmissibly high can be adjusted by suitably selecting the dimensioning of the common series resistor, the type of glow lamp as well as the characteristic of the PTC element. When the ambient temperatures are within allowable limits, the PTC element is relatively low-resistance, so that the voltage residing at the glow lamp is not sufficient to ignite it. However, if the ambient temperature assumes inadmissibly high values, the resistance of the PTC element becomes high, causing the voltage residing at the glow lamp to increase, igniting it. The operating point is dependent on the specific dimensioning of the elements and is within the discretion of the person skilled in the art.

In another embodiment of the present invention in which the hair dryer is equipped with a thermostatic switch de-energizing the hair dryer when the temperature of the heating means exceeds a predetermined limit, the threshold value for the signaling device is selected so as to lie below the limit temperature. Advantageously, this prevents the thermostatic switch from de-energizing the hair dryer on attainment of the limit temperature without the user having been previously informed of the excessive degree of contamination of the filter element by the signaling device.

In an embodiment of the present invention which has proved to be extremely advantageous, the detecting means are arranged in a section of the housing proximate the blower structure. In this embodiment, the passing air flow cools the temperature sensor heated, for example, by means of a separate heating means. Surprisingly, the separate heating means or the temperature sensor experiences a greater cooling effect when the filter element is contaminated than it does in the case of clean filter elements. This appears to be attributable to the fact that a very substantial turbulence occurs in the area of the suction side of the hair dryer whenever the resistance to air flow on the air inlet side exceeds specific values. By virtue of this effect of a significant change in the flow pattern, it is possible to accurately determine the degree of contamination of the filter element.

In an advantageous further development of the present invention, the detecting means are arranged in a section of the housing between the filter element and the blower structure, particularly the impeller. Experiments have revealed that in this particular housing section the changes in the flow pattern are noticeable particularly clearly, enabling the detecting means to detect them more easily.

In another advantageous development of the present invention, the detecting means are formed of a heating element and a temperature sensor thermally coupled to each other. The sensitivity of the detecting means is materially increased by allocating a separate heating means to the temperature sensor.

A particularly advantageous embodiment of the present invention results by configuring the heating element and the temperature sensor each as a PTC element secured or connected to each other directly, with a signal element being connected in series with the temperature sensor. If the heating means and thus also the temperature sensor is cooled to a greater degree than would be the case under clean filter conditions because of the formation of turbulence in the section associated with the blower structure, the resistance of the temperature sensor configured as a PTC element will drop, enabling a higher current to flow therethrough which activates a signal element as, for example, a light-emitting diode, or an audible warning device as, for example, a piezoelectric buzzer.

By providing the detecting means with an integrating means suppressing output signals which would cause an only momentary activation of the signaling device, the presence of an inadmissible operating condition of the hair dryer lasting a very short time only will not be indicated. Such situations may be a momentary occurrence, for example, when switching from one air flow setting to another, when turning the hair dryer on, or when changing the heat setting, without this being due to an excessive degree of contamination of the filter element. While such momentary conditions are normal, they need not be indicated to the user by a flashing signal lamp or a brief sounding of the signaling device. The integrating means serves the function of suppressing these signals, the integration time constant being preferably in the range of between 0.25 and 5 minutes.

Further objects, features, advantages and application possibilities of the present invention will become apparent from the subsequent description of embodiments. It will be understood that all features described and/or represented by illustration, whether taken alone or in any desired combination, form the subject-matter of the present invention, irrespective of their summarization in the claims or their back-references. In the drawings, FIG. 1 is a sectional view of the housing of a hair dryer; and FIGS. *2a*, *2b* are schematics illustrating two embodiments of the detecting means.

As shown in the drawings, a hair dryer 10 is comprised of a tubular housing 12 having a handle 14. The tubular housing 12 has at its respective ends an air inlet opening 16 and an air exit opening 18. A filter element 20 is arranged between a cover 19 of the air inlet opening 16 and a blower structure 21 comprising an impeller 22, an impeller motor 24 and an adjacent downstream guide wheel 26. Downstream of the guide wheel 26, a heating means 27 is located in the housing 12, the heating means including a heater supporting structure 28 around which a heating wire 30 is wound in a meandering pattern.

Mounted on the heater supporting structure 28 are a detecting means 32 and, where applicable, a thermostatic switch 35 de-energizing the entire hair dryer when a limit temperature is exceeded. As indicated in simplified form by means of the terminal 36, the detecting means 32 is connected to a terminal 42 of a signaling device 40.

The signaling device 40 may be configured as a visual or audible signal element which may be provided on the hair dryer 10 at any desired location, depending on space available or visibility of the visual display.

An alternative to the arrangement of the detecting means 32 in the area of the heating means 27 is the arrangement of a detecting means 34, indicated in broken lines, in the housing section between the filter element 20 and the impeller 22. It will be understood that the location illustrated in FIG. 1 is given by way of example, the precise location of the detecting means 34 being governed by the specific flow pattern of the individual hair dryer in this particular section proximate the blower structure 21. The detecting means 34 is equally provided with a terminal 38 connected to a terminal 42 of the signaling device 40.

The detecting means 32 of FIG. *2a* includes a temperature sensor 44 which may be particularly configured as a PTC element. Connected in parallel with the temperature sensor 44 is a signal element 48 which is configured as a glow lamp in the embodiment and is disposed in signalling device 40. This parallel arrangement of the temperature sensor 44 and the signal element 48 is connected to the terminals 58 of a voltage supply via a series resistor 52.

The temperature sensor 44 arranged in the area of the heating means 27 which in turn is connected to the voltage supply via supply terminals 54 is heated to the temperature prevailing in the housing 12 of the hair dryer 10 in dependence on the respective heat and air flow settings. By virtue of the dimensioning of the components used, the circuit arrangement is dimensioned such that in the presence of allowable temperatures the resistance of the temperature sensor 44 configured as a PTC element assumes relatively low values, so that the voltage drop occurring is not sufficient to ignite the glow lamp 48. By contrast, if the filter element 20 is highly contaminated, the amount of air supplied to the heating means will be reduced, resulting in an increase in the sensed temperature. The resistance of the temperature sensor 44 and the voltage drop occurring across it will increase up to the point at which the glow lamp 48 ignites. The precise operating point may be achieved, for example, by suitably dimensioning the series resistor 52 and selecting a PTC resistor with an appropriate characteristic.

In the embodiment of FIG. *2b*, the detecting means 34 arranged in the housing section between the filter element 20 and the blower structure 21 is configured as follows: The temperature sensor 144 which is equally a PTC element is connected in series with a signal element 50 disposed in signalling device 40, this series arrangement being connected to the voltage supply by means of terminals 58. The temperature sensor 44 is associated with a heating element 46 of its own, the two components being interconnected by a thermal coupling 56. In the simplest case, the temperature sensor 44 and the heating element 46 form an assembly 56. The heating element 46, too, is preferably a PTC element connected to the voltage supply by means of supply terminals 54.

Under normal conditions, the heating element 46 operates the temperature sensor 44 in a high-resistance range by suitable selection of the characteristics of these two elements, so that the signal element 50 which is, for example, a light-emitting diode or an incandescent filament lamp, is not activated. Surprisingly, with the filter element 20 highly contaminated, the flow pattern between the filter element 20 and the impeller 22 changes significantly because of the formation of turbulence. This turbulence intensifies the cooling effect on the heating element 46, thus resulting in a drop in temperature of the temperature sensor 44. This sensor experiences a reduction in its resistance, thereby activating the signal element 50.

The two embodiments of FIGS. *2a*, *2b* have as common feature that an integrating means 60 may be associated with the detecting means 32, 34 for the suppression of output signals of the temperature sensor 44 which would activate the signal elements 48, 50 for a very short time only. Perfectly normal, momentary temperature variations of the temperature sensor 44 which would result in an activation of the signaling device 40 are thereby suppressed. Only when such temperature variations last a period of time of some length will they cause an activation of the signaling device 40. Preferred time constants of the integrating means 60 are in the range of between 0.25 and 5 minutes.

We claim:

1. A hair dryer comprising housing structure air inlet opening structure in said housing structure, air exit opening structure in said housing structure, blower structure in said housing structure, heater structure in said housing structure, filter structure in said housing structure adjacent said air inlet opening structure, said blower generating an air stream through the inside of said housing structure when operating, temperature detector circuitry in said housing structure for producing an output signal representing an actual temperature inside the housing structure, said output signal being uncompensated for ambient temperature outside of said housing structure, a thermostatic switch in said housing structure exposed to said air stream, said thermostatic switch for de-energizing said hair dryer in response to a temperature at said thermostatic switch exceeding a predetermined limit temperature, a signalling device connected to said temperature detector circuitry for actuation upon attainment by said output signal of a predetermined threshold value, and means for adjusting said threshold value response of said signalling device to a value below said limit temperature.

2. The hair dryer of claim 1 wherein said temperature detector circuitry includes a PTC element.

3. The hair dryer of either claim 1 or claim 2 and further including heater support structure on which said heater structure is mounted, and wherein said temperature detector circuitry is mounted on said heater support structure.

4. The hair dryer of either claim 1 or claim 2 wherein said temperature detector circuitry includes a series circuit comprising a series resistor and a PTC element and said signalling device includes a visual signalling element in parallel with said series circuit.

5. The hair dryer of either claim 1 or claim 2 wherein said temperature detector circuitry includes integrator means with a time constant in the range of 0.2–5 minutes for suppressing output signals to avoid momentary activation of said signalling device.

6. The hair dryer of claim 2 wherein said temperature detector circuitry is disposed in said housing structure adjacent said blower structure.

7. The hair dryer of claim 6 wherein said blower structure includes an impeller and said temperature detector circuitry is disposed in said housing structure between said filter element and said impeller of said blower structure.

8. The hair dryer of claim 6 wherein said temperature detector circuitry includes a heater element and a temperature sensor interconnected with said heating element by thermal coupling structure.

9. The hair dryer of claim 1 wherein said temperature detector circuitry is disposed adjacent said blower structure.

10. The hair dryer of claim 9 wherein said blower structure includes an impeller and said temperature detector circuitry is disposed in said housing structure between said filter element and said impeller of said blower structure.

11. The hair dryer of claim 9 wherein said temperature detector circuitry includes a heating element and a temperature sensor interconnected with said heating element by thermal coupling structure.

12. The hair dryer of claim 11 wherein each of said heating element and said temperature sensor is a PTC element, and said signalling device includes a signal element connected in series with said temperature sensor.

* * * * *

UNITED STATES PATENT AND TRADEMARK OFFICE

CERTIFICATE OF CORRECTION

PATENT NO. : 5,448,677

DATED : September 5, 1995

INVENTOR(S) : Fell et al.

It is certified that error appears in the above-indentified patent and that said Letters Patent is hereby corrected as shown below:

Title page, item [56]

In the References Cited section, insert the below listed references under Foreign Patent Documents on the Cover Page:

–64-61998 3/1989 Japan
14-89316 10/1977 Great Britain
21-28799 05/1190 Japan
60-260597 10/1988 Japan
58-180216 10/1983 Japan
57-147035 09/1982 Japan
4-200593 07/1992 Japan
4-126199 04/1992 Japan
4-256799 09/1992 Japan
4-366359 12/1992 Japan
4-327714 11/1992 Japan
5-157358 06/1993 Japan
5-322259 12/1993 Japan
5-161793 06/1993 Japan
2-64329 03/1990 Japan –

UNITED STATES PATENT AND TRADEMARK OFFICE

CERTIFICATE OF CORRECTION

PATENT NO. : 5,448,677

DATED : September 5, 1995

INVENTOR(S) : Fell et al.

It is certified that error appears in the above-indentified patent and that said Letters Patent is hereby corrected as shown below:

Col. 4, line 46, replace "144" with --44--.

Col. 5, claim 1, line 18, after "structure" insert a comma.

Signed and Sealed this

Thirtieth Day of July, 1996

Bruce Lehman

*Attest:*

BRUCE LEHMAN

*Attesting Officer*

*Commissioner of Patents and Trademarks*